US009670025B2

(12) United States Patent
Zhang et al.

(10) Patent No.: US 9,670,025 B2
(45) Date of Patent: Jun. 6, 2017

(54) TEMPORARY BANKNOTE STORAGE DEVICE AND METHOD FOR IMPROVING COILING BLOCK STORAGE CAPACITY

(71) Applicant: GRG Banking Equipment Co., Ltd., Guangzhou, Guangdong (CN)

(72) Inventors: Tao Zhang, Guangdong (CN); Weibin Chen, Guangdong (CN); Zhiqiang Sun, Guangdong (CN); Canjie Wang, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/109,316

(22) PCT Filed: Jan. 6, 2015

(86) PCT No.: PCT/CN2015/070164
§ 371 (c)(1),
(2) Date: Jun. 30, 2016

(87) PCT Pub. No.: WO2015/106645
PCT Pub. Date: Jul. 23, 2015

(65) Prior Publication Data

US 2016/0340141 A1 Nov. 24, 2016

(30) Foreign Application Priority Data

Jan. 16, 2014 (CN) ..... 2014 1 0020452

(51) Int. Cl.
*B65H 29/00* (2006.01)
*B65H 5/28* (2006.01)
*B65H 43/00* (2006.01)

(52) U.S. Cl.
CPC ..... *B65H 29/006* (2013.01); *B65H 5/28* (2013.01); *B65H 43/00* (2013.01);
(Continued)

(58) Field of Classification Search
CPC ..... B65H 29/006; B65H 5/28; B65H 2301/41912
See application file for complete search history.

(56) References Cited

U.S. PATENT DOCUMENTS 6,669,136 B2 * 12/2003 Niioka ..... B65H 29/006 242/528
6,834,808 B2 * 12/2004 Satou ..... B65H 29/006 235/475

(Continued)

FOREIGN PATENT DOCUMENTS

CA 2096987 A1 11/1993
CN 101331076 A 12/2008

(Continued)

OTHER PUBLICATIONS

International Search Report for PCT/CN2015/070164, mailed Mar. 25, 2015, ISA/CN.

*Primary Examiner* — Luis A Gonzalez
(74) *Attorney, Agent, or Firm* — Yue Xu; U.S. Fairsky LLP

(57) ABSTRACT

A temporary banknote storage device, includes a first sensor, a second sensor, a storage coiling block, a spare tape coiling block, a coiled tape having two ends which are fixed on the storage coiling block and the spare tape coiling block respectively and are capable of coiling, uncoiling and winding between the storage coiling block and the spare tape coiling block, a transfer channel, a first power motor, a second power motor, a third power motor and a microcontroller. The microcontroller controls the first power motor, the second power motor and the third power motor. A method for improving coiling block storage capacity is further provided.

5 Claims, 4 Drawing Sheets

(52) U.S. Cl.
CPC ..... *B65H 2301/4191* (2013.01); *B65H 2301/41912* (2013.01); *B65H 2511/51* (2013.01); *B65H 2513/108* (2013.01); *B65H 2513/20* (2013.01); *B65H 2557/242* (2013.01); *B65H 2701/1912* (2013.01)

(56) References Cited

U.S. PATENT DOCUMENTS

| | | | | |
|---|---|---|---|---|
| 8,256,604 | B2 * | 9/2012 | Ohishi | B65H 29/006 194/206 |
| 2009/0134262 | A1 | 5/2009 | Elbel | |
| 2010/0133737 | A1 | 6/2010 | Cismpi et al. | |
| 2013/0081922 | A1 | 4/2013 | Amo | |
| 2016/0167913 | A1 * | 6/2016 | Xiao | B65H 29/006 242/390 |

FOREIGN PATENT DOCUMENTS

| | | | | |
|---|---|---|---|---|
| CN | 102236932 | A | | 11/2011 |
| CN | 102884553 | A | | 1/2013 |
| CN | 102930638 | A | | 2/2013 |
| CN | 103395654 | A | | 11/2013 |
| CN | 103754688 | A | | 4/2014 |
| EP | 2922038 | A1 | | 6/2013 |
| JP | H10632514 | A | | 2/1994 |
| JP | 11224362 | A | * | 8/1999 |
| WO | 2011155019 | A1 | | 12/2011 |

* cited by examiner

TEMPORARY BANKNOTE STORAGE DEVICE AND METHOD FOR IMPROVING COILING BLOCK STORAGE CAPACITY

CROSS REFERENCE OF RELATED APPLICATION

The present application is the national phase of International Application No. PCT/CN2015/070164, titled " TEMPORARY BANKNOTE STORAGE DEVICE AND METHOD FOR IMPROVING COILING BLOCK STORAGE CAPACITY", and filed on Jan. 6, 2015, which claims the priority to Chinese Patent Application No. 201410020452.6, titled "TEMPORARY BANKNOTE STORAGE DEVICE AND METHOD FOR IMPROVING COILING BLOCK STORAGE CAPACITY", filed on Jan. 16, 2014 with the State Intellectual Property Office of People's Republic of China, both of which are incorporated herein by reference in their entireties.

FIELD

The present disclosure relates to a financial self-service device, and in particular to a temporary banknote storage device which stores banknotes with a reel and a tape, and to a control method for improving a reel storage capacity of a temporary banknote storage device.

BACKGROUND

Presently, a storage device having a reel/tape structure is generally used to store banknotes. The storage device includes a storage reel driven by a first power motor, a spare tape reel driven by a second power motor, and a tape, of which two ends are fixed on the storage reel and the spare tape reel respectively, and is coiled, uncoiled and winded between the storage reel and the spare tape reel. The first power motor and the second power motor are controlled to start or stop by a microcontroller. The storage device stores banknotes through the reel in cooperation with the tape.

Presently, banknotes are controlled to enter the storage device as follows. A third power motor drives a channel outside the device to transfer the banknotes, the device is started once the banknote is to enter the device, and a linear speed of a channel inside the device is the same as that of the channel outside the device. The banknotes successively enter the device and are bound on the storage reel by the tape, and the power motor in the device keeps operating during transferring of adjacent banknotes. The control mode has the following disadvantages. 1. A space between adjacent banknotes should not be too small due to the limitation of identifying and reversing the banknotes, and a part of the tape is occupied to meet the space between adjacent banknotes when the banknotes successively enter the device, thereby leading to a low utilization of the tape. 2. In order to meet the storage requirement, the device needs to have a certain space volume to accommodate the tape and the banknotes on the storage reel, thereby leading to a large structural space. 3. For tapes with the same length and structural spaces with the same volume, storage capacities of the devices are limited and can not be improved.

SUMMARY

In order to address the issue of low utilization of the tape in the temporary banknote storage device, a temporary banknote storage device is provided in the present disclosure. The device improves a reel storage capacity through shortening a space between two adjacent banknotes on the tape.

A method for improving a reel storage capacity of a temporary banknote storage device is further provided in the present disclosure. The method improves a utilization of the tape by shortening a space between two adjacent banknotes in the temporary banknote storage device, thereby improving a reel storage capacity.

The temporary banknote storage device includes a storage reel driven by a first power motor; a spare tape reel driven by a second power motor; a tape, of which two ends are fixed on the storage reel and the spare tape reel respectively, and is coiled, uncoiled and winded between the storage reel and the spare tape reel; a first sensor, arranged at an entrance of the temporary banknote storage device and configured to detect whether a banknote enters the temporary banknote storage device; a second sensor, arranged between the first sensor and the storage reel, being a certain distance $S_{transfer}$ from the first sensor, and configured to detect whether the banknote completely enters the temporary banknote storage device; a transfer channel outside the device, arranged between the first sensor and the second sensor; a third motor, configured to drive the transfer channel outside the device, to transfer the banknote from a position of the first sensor to a position of the second sensor at a constant speed; and a microcontroller, configured to control components to operate normally, control the first power motor to start acceleratingly when the first sensor detects a front end of the banknote, and control the first power motor to stop in a deceleration way when the second sensor detects leaving of a tail end of the banknote.

Preferably, the microcontroller controls the first power motor to complete an accelerating start before the front end of the banknote arrives at the second sensor, and control the first power motor to transfer, after the first power motor completes the accelerating start, the banknote from the position of the second sensor until the tail end of the banknote leaves the second sensor at a same speed as that of the third power motor.

A method for improving a reel storage capacity of a temporary banknote storage device is provided. The method includes: step 1, driving, by a third power motor, a channel outside the device, to transfer successive banknotes from a position of a first sensor to a position of a second sensor sequentially at a constant speed v, where a space between two adjacent banknotes in the channel outside the device is $L_{outside}$; step 2, when the first sensor detects arrival of a front end of a banknote, starting acceleratingly a first power motor to drive a storage reel until a linear speed of a tape is equal to the speed v of the channel outside the device, where the first power motor already completes an accelerating start when the front end of the banknote enters the second sensor; step 3, stopping in a deceleration way the first power motor when the second sensor detects arrival of a tail end of the banknote; and step 4, transferring, through performing the step 2 and the step 3 repeatedly, the banknotes to the temporary banknote storage device during a process that the banknotes successively enter the temporary banknote storage device, where in order to control the starting and stopping of the first power motor, i.e., for two adjacent banknotes, a tail end of a first banknote already leaves the second sensor and is in a deceleration way stopped when a front end of a second banknote arrives at the first sensor, it is required $L_{outside}>S_{transfer}+2\times S_{decelerating}$, where $S_{transfer}$ refers to a distance between the first sensor and the second sensor, and the $S_{decelerating}$ refers to a distance for the first banknote transferred during decelerating stop of the first power motor after the tail end of the first banknote leaves the second sensor.

Preferably, from the step 2 to the step 4, the second power motor is in a braking state during a rotation of the first power motor, and the tape is tightened through a load of the temporary banknote storage device and a braking moment of the second power motor.

Preferably, in the step 4, a space between two adjacent banknotes is $L_{spacing}$ after the banknotes enter the temporary banknote storage device, and a method for calculating the $L_{spacing}$ includes: a first step, calculating a transfer distance $S_{decelerating}$ of the first banknote from the time instant when the first banknote leaves the second sensor to the time instant when the first banknote is in a deceleration way stopped, $S_{decelerating} \approx v \times t_{decelerating}/2$, where a period of accelerating start for the first power motor is $t_{accelerating}$, a period of decelerating stop is $t_{decelerating}$, and the first banknote is already stored in the device; a second step, calculating a constant rotation speed period $t_{constantspeed}$ of the first power motor before the front end of the second banknote arrives at the second sensor, $t_{constantspeed} = S_{transfer}/v - t_{accelerating}$, where the second banknote enters the device immediately following the first banknote, the first power motor is acceleratingly started when the front end of the second banknote arrives at the first sensor, the first banknote is driven by the tape to transfer continuously in the temporary banknote storage device, the second banknote is transferred on the transfer channel outside the device which is driven by the third power motor before the front end of the second banknote arrives at the second sensor, a transfer speed of the second banknote is v, a period from a time instant when the front end of the second banknote arrives at the first sensor to a time instant when the front end of the second banknote arrives at the second sensor is $S_{transfer}/v$, the first power motor already completes acceleration start and reaches a constant speed v be ore the front end of the second banknote arrives at the second sensor, and $t_{accelerating} < S_{transfer}/v$; a third step, calculating a transfer distance $S_{accelerating}$ of the first banknote in the device during the accelerating start of the first power motor, $S_{accelerating} \approx v \times t_{accelerating}/2$, where the front end of the second banknote is transferred from the first sensor to the second sensor; a fourth step, calculating a transfer distance $S_{constantspeed}$ of the first banknote during a period when the first power motor rotates at a constant speed before the front end of the second banknote arrives at the second sensor, $S_{constantspeed} = v \times t_{constantspeed}$; and a fifth step, calculating a space between the first banknote and the second banknote in the temporary banknote storage device, $$\begin{aligned} L_{spacing} &= S_{decelerating} + S_{accelerating} + S_{constantspeed} \\ &= v \times t_{decelerating}/2 + v \times t_{accelerating}/2 + v \times t_{constantspeed} \\ &= S_{transfer} - v \times t_{accelerating}/2 + v \times t_{decelerating}/2 \\ &= S_{transfer} - S_{accelerating} + S_{decelerating}, \end{aligned}$$

where $t_{accelerating} < S_{transfer}/v$, the second banknote gradually enters the temporary banknote storage device after the front end of the second banknote arrives at the second sensor, and reaches a same transfer speed as the first banknote, and the space between the first banknote and the second banknote remains constant.

Preferably, during a process that the banknotes successively enter the temporary banknote storage device and are bound on the storage tape by the tape, an outer diameter of the storage reel increases continuously. In a condition of a constant operation speed v of the tape, a target rotation speed of the first power motor decreases as a radius increases, and different motor starting curves are adopted depending on different outer diameters of the storage reel, so that a starting period $t_{accelerating}$ of the first power motor for arriving at the target rotation speed is approximately a constant value for each banknote during changes of the outer diameter of the storage reel.

Based on the temporary banknote storage device in the present disclosure, a space between two adjacent banknotes in the temporary banknote storage device is less than a space between the two adjacent banknotes outside the device with the method for controlling the starting or stopping, thereby increasing a utilization of the tape and the structural space, and improving a storage capacity of the device.

DETAILED DESCRIPTION

In order to further clarify the temporary banknote storage device of the present disclosure, hereinafter the temporary banknote storage device is described in detail in conjunction with drawings of a preferable embodiment of the present disclosure.

Figure 1:
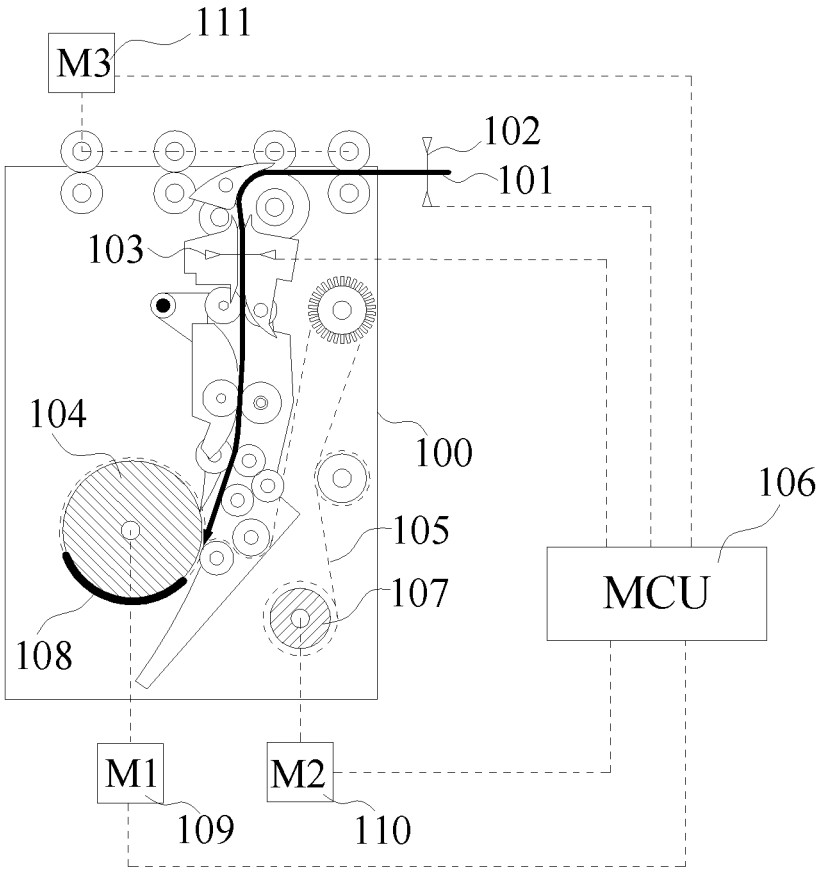
FIG. 1 is a side view of a structure of a temporary banknote storage device according to a preferable embodiment of the present disclosure.

FIG. 1 is a side view of a temporary banknote storage device 100 of the present disclosure. The temporary banknote storage device 100 includes a first sensor 102, a second sensor 103, a storage reel 104, a spare tape reel 107, a tape 105 of which two ends are fixed on the storage reel 104 and the spare tape reel 107 respectively and is coiled, uncoiled and winded between the storage reel 104 and the spare tape reel 107, a transfer channel 101, a first power motor 109, a second power motor 110, a third power motor 111 and a microcontroller 106. The transfer channel 101 includes two segments. A first segment is a channel outside the device between the first sensor 102 and the second sensor 103 on the transfer channel 101, and is driven and controlled by the third power motor 111. A second segment is between the second sensor 103 and the storage reel 104 on the transfer channel 101, and is driven and controlled by the first power motor 109 via the tape 105. The microcontroller 106 controls the first power motor 109, the second power motor 110 and the third power motor 111. Specifically, the first power motor 109 drives the storage reel 104, the second power motor 110 drives the spare tape reel 107 and the third power motor drives the channel outside the device between the first sensor 102 and the second sensor 103. A banknote 108 enters the temporary banknote storage device 100 through the transfer channel 101 and is stored on the storage reel 104 through the tape 105. The first sensor 102 detects whether the banknote 108 enters the temporary banknote storage device 100, based on whether the first sensor 102 detects a front end of the banknote. The second sensor 103 is configured to detect whether the banknote completely enters the temporary banknote storage device 100, based on whether a tail end of the banknote leaves the second sensor 103.

Figure 2:
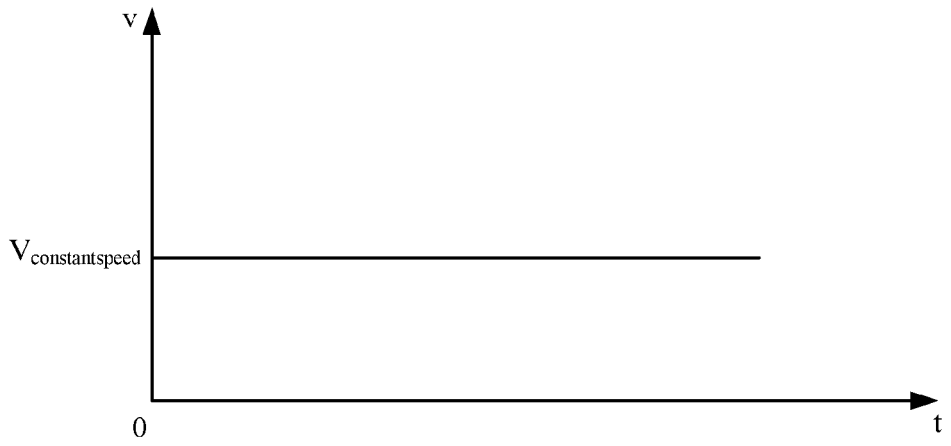
FIG. 2 is a v-t diagram showing a constant speed operation of a channel outside the device.
Figure 3:
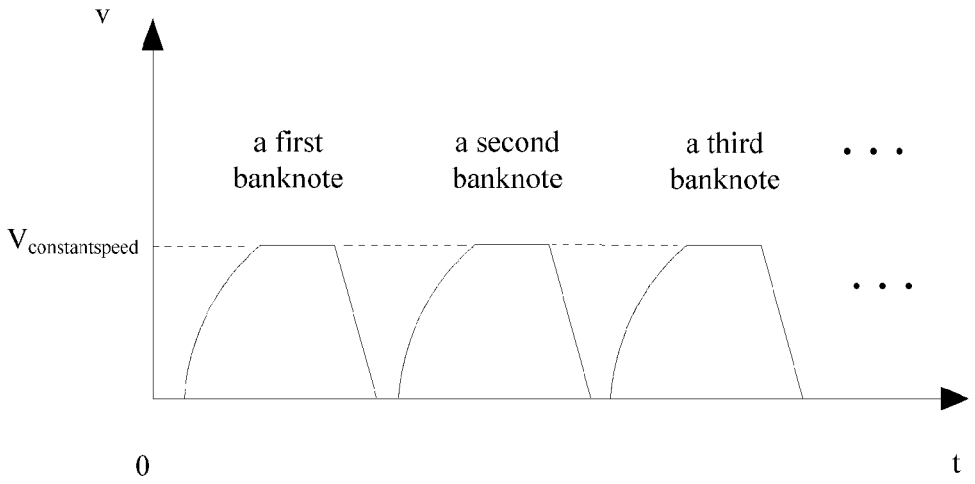
FIG. 3 is a v-t diagram showing starting or stopping operation of a channel inside the device.

A principle for controlling a banknote to enter the temporary banknote storage device 100 is illustrated in conjunction with FIG. 1, FIG. 2 and FIG. 3.

The banknote 108 enters the temporary banknote storage device 100 along the transfer channel 101. When entering the temporary banknote storage device 100, the banknote 108 firstly passes through the channel outside the device, i.e., the first segment of the transfer channel 101. As shown in FIG. 2, in the first segment of the transfer channel 101, the banknote 108 is transferred at a constant speed $V_{constantspeed}$. When a front end of the banknote 108 arrives at the first sensor 102, the first power motor 109 acceleratingly starts; and before the front end of the banknote 108 arrives at the second sensor 103, the first power motor 109 already completes accelerating start and reaches a speed $V_{constantspeed}$, such that the banknote 108 is transferred in the second segment of the transfer channel 101 at a same linear speed as that in the first segment, to enter the temporary banknote storage device 100. In a case that the tail end of the banknote 108 leaves the second sensor 103, it is indicated that the banknote 108 completely enters the temporary banknote storage device 100, and at this time the first power motor 109 in a deceleration way stops. In this way, one banknote is controlled to enter the temporary banknote storage device 100. During a process that banknotes are successively transferred to the temporary banknote storage device 100 through the channel outside the device, the first power motor 109 is controlled by the microcontroller 106 to start and stop repeatedly to transfer the banknotes to the temporary banknote storage device 100 one by one, as shown in FIG. 3.

Figure 4:
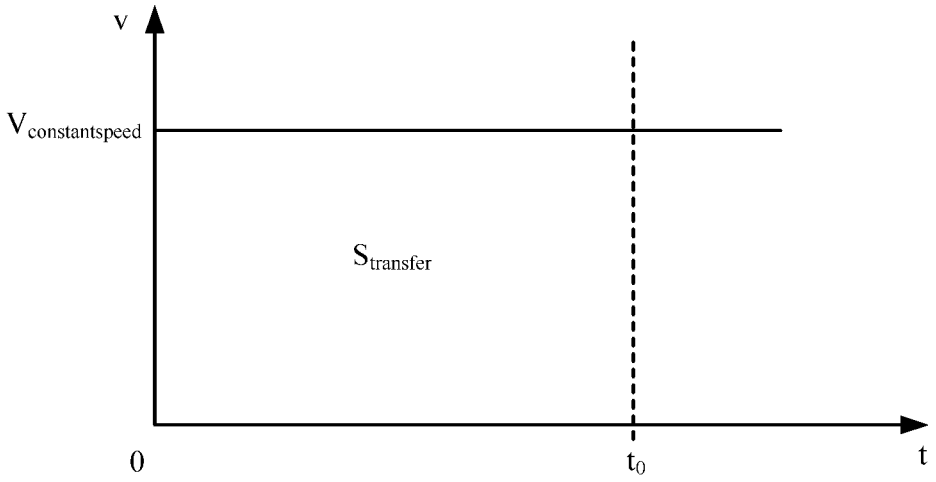
FIG. 4 is a v-t diagram showing a constant speed control for banknotes.
Figure 5:
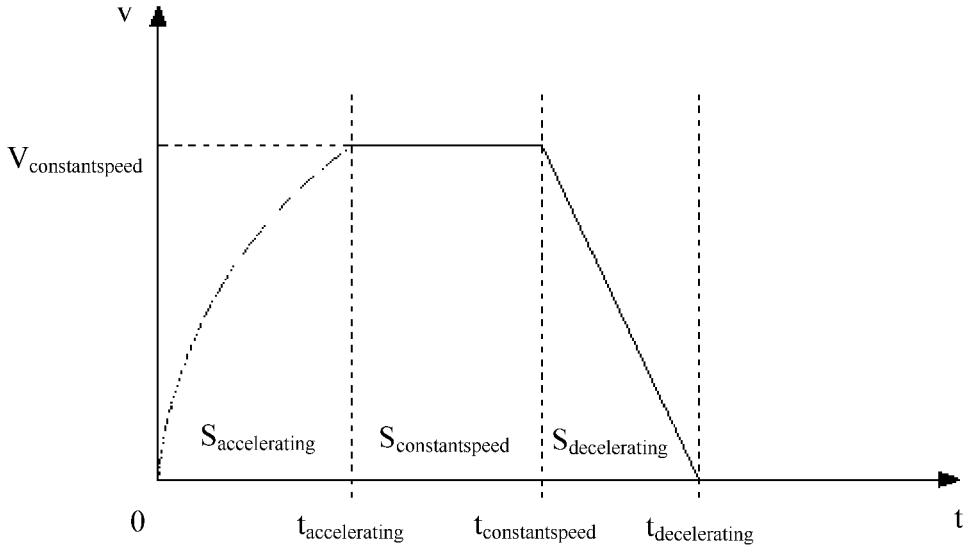
FIG. 5 is a v-t diagram showing start-stop control for banknotes.

A principle for controlling a space between adjacent banknotes in the device is illustrated in conjunction with FIG. 1, FIG. 4 and FIG. 5.

Hereinafter the principle for controlling the space between adjacent banknotes in the temporary banknote storage device 100 is described with an example that two successive banknotes enter the temporary banknote storage device 100. It is assumed that, a space between two banknotes in the channel outside the device is $L_{outside}$, a space between the first sensor 102 and the second sensor 103 is $S_{transfer}$, and a space between adjacent banknotes 108 in the device is $L_{spacing}$.

After a first banknote enters the temporary banknote storage device 100 through the channel outside the device, a tail end of the first banknote leaves the second sensor 103 driven by the first power motor 109, and then the first banknote in a deceleration way stops in the temporary banknote storage device 100. A period for decelerating stop is $t_{decelerating}$, and the first banknote is transferred for a distance $S_{decelerating}$ during the decelerating process. In order to transfer banknotes to the temporary banknote storage device 100 one by one through start-stop control from first power motor 109, it is required that a front end of a second banknote arrives at the first sensor 102 after the first banknote is in a deceleration way stopped in the temporary banknote storage device 100.

When the front end of the second banknote arrives at the first sensor 102, the first power motor 109 is acceleratingly started. As shown in FIG. 5, a period for accelerating start is $t_{accelerating}$, and the first banknote is transferred for a distance $S_{accelerating}$ in the temporary banknote storage device 100 driven by the first power motor during the accelerating start of the first power motor.

Subsequently, the second banknote is transferred to the temporary banknote storage device 100 continuously along the transfer channel 101. From a time instant when the front end of the second banknote arrives at the first sensor 102 to a time instant when the front end of the second banknote arrives at the second sensor 103 driven by the third power motor, the first power motor 109 completes accelerating start, operates for a period $t_{constantspeed}$ at a constant speed $v_{constantspeed}$, and drives the first banknote to transfer for a distance $S_{constantspeed}$ in the temporary banknote storage device 100 at the constant speed.

After the front end of the second banknote arrives at the second sensor 103, a speed of the first power motor 109 reaches the constant speed $v_{constantspeed}$, and the second banknote enters the temporary banknote storage device 100 at the same speed $v_{constantspeed}$ as that of the first banknote. When the tail end of the second banknote leaves the second sensor 103, the second banknote already gets out of power of the channel outside the device and enters the temporary banknote storage device 100 completely, the first power motor 109 is in a deceleration way stopped, a period for decelerating stop is $t_{decelerating}$, and the second banknote is also transferred for the distance $S_{decelerating}$ in the temporary banknote storage device 100. In this way, the second banknote smoothly enters the temporary banknote storage device 100 and the space between the second banknote and the first banknote is determined. That is, after the front end of the second banknote arrives at the second sensor 103, the second banknote enters the temporary banknote storage device 100 at the same speed as that of the first banknote, including a constant speed phase and a decelerating phase. After the second banknote completely enters the temporary banknote storage device 100 and is in a deceleration way stopped, there is no relative motion between the second banknote and the first banknote regardless of start-stop driving of the first power motor, and hence the space between the two adjacent banknotes is determined.

Hereinafter a method for calculating the space $L_{spacing}$ between adjacent banknotes in the device is illustrated in detail.

During a process that the second banknote enters the temporary banknote storage device 100, the first banknote and the second banknote are transferred at the same speed when the front end of the second banknote arrives at the second sensor 103, and hence the space $L_{spacing}$ between two banknotes in the device is equal to a sum of a transfer distance $S_{decelerating}$ of the first banknote during a process that the tail end of the first banknote leaves the second sensor 103 and is in a deceleration way stopped after the first banknote enters the temporary banknote storage device 100, a transfer distance $S_{accelerating}$ of the first banknote in the device during accelerating start of the first power motor, and a constant speed transfer distance $S_{constantspeed}$ of the first banknote driven by the first power motor before the front end of the second banknote arrives at the second sensor 103, i.e., $$L_{spacing}=S_{decelerating}+S_{accelerating}+S_{constantspeed}.$$

In a case that a period for accelerating start of the first power motor 109 is $t_{accelerating}$, the transfer distance of the first banknote may be approximately given as:

$$S_{accelerating}\approx v_{constantspeed}\times t_{accelerating}/2$$

(an error is small, and the acceleration motion may be regarded as a uniform acceleration motion approximately).

In a case that the first power motor 109 rotates at a constant speed for a time period $t_{constantspeed}$ before the front end of the second banknote arrives at the second sensor 103, the transfer distance $S_{constantspeed}$ of the first banknote is given as:

$$S_{constantspeed}=v_{constantspeed}\times t_{constantspeed}.$$

In a case that a period for decelerating stop of the first power motor 109 is $t_{decelerating}$, the transfer distance $S_{decelerating}$ of the first banknote during a process that the tail end of the first banknote leaves the second sensor 103 and is in a deceleration way stopped may be approximately given as:

$$S_{decelerating}\approx v_{constantspeed}\times t_{decelerating}/2$$

(an error is small, and the acceleration motion may be regarded as a uniform acceleration motion approximately).

In a design, the period $t_{accelerating}$ for accelerating start and the period $t_{decelerating}$ for decelerating stop of the first power motor 109 are known. As shown in FIG. 4, during a period from a time instant when the front end of the second banknote arrives at the first sensor 102 to a time instant when the front end of the second banknote arrives at the second sensor 103, the second banknote is transferred for a distance $S_{transfer}$. Since the second banknote is driven by the third power motor at a constant speed $V_{constantspeed}$, a period for the transfer process is $t_0=S_{transfer}/v_{constantspeed}$. In addition, the transfer period $t_0$ for the second banknote during the process is equal to a sum of the period $t_{accelerating}$ for accelerating start of the first banknote and the constant speed transfer period $t_{constantspeed}$ for the first banknote in the temporary banknote storage device 100, therefore, the constant speed transfer period $t_{constantspeed}$ of the first banknote may be given as:

$$t_{constantspeed}=S_{transfer}/v_{constantspeed}-t_{accelerating}.$$

The constant speed transfer distance $S_{constantspeed}$ of the first banknote is given as:

$$S_{constantspeed}=v_{constantspeed}\times t_{constantspeed}=v_{constantspeed}\times(S_{transfer}/v_{constantspeed}-t_{accelerating})=(S_{transfer}-v_{constantspeed}\times t_{constantspeed}.$$

The space $L_{spacing}$ between adjacent banknotes in the temporary banknote storage device 100 may be given as:

$$L_{spacing}=S_{accelerating}+S_{decelerating}+S_{constantspeed}$$
$$=S_{transfer}-v_{constantspeed}\times t_{accelerating}/2+v_{constantspeed}\times t_{accelerating}/2.$$

Therefore, a relation of a design space $S_{transfer}$ between the first sensor 102 and the second sensor 103, with the $L_{spacing}$ between adjacent banknotes in the temporary banknote storage device 100 may be given as:

$$S_{transfer}=L_{spacing}+v_{constantspeed}\times t_{accelerating}/2-v_{constantspeed}\times t_{accelerating}/2.$$

The control process should meet two requirements as follows.

A first requirement is that the first power motor 109 completes accelerating start before the front end of the second banknote arrives at the second sensor 103, i.e., $$t_{accelerating}<S_{transfer}/v_{constantspeed}.$$

A second requirement is that the first banknote leaves the second sensor 103 and is in a deceleration way stopped when the second banknote arrives at the first sensor 102, i.e., the $S_{transfer}$ and the $L_{spacing}$ should meet:

$$L_{outside}>S_{transfer}+v_{constantspeed}\times t_{accelerating}.$$

Based on a relationship between the $S_{transfer}$ and $L_{spacing}$, and based on the two requirements, a position of the first sensor 102 can be determined, so as to decrease the space between adjacent banknotes in the temporary banknote storage device 100.

Hereinafter it is illustrated in conjunction with an actual control.

For the actual control, a space between adjacent banknotes in the channel outside the device is $L_{outside}$=90 mm, the space $L_{spacing}$ between adjacent banknotes in the temporary banknote storage device 100 is controlled to be $L_{spacing}$=30 mm, and the transfer speed of the channel outside the device is $V_{constantspeed}$=0.8 mm/ms. For the first power motor 109, the period for accelerating start is $t_{accelerating}$=50 ms, and the period for decelerating stop is $t_{decelerating}$=10 ms.

$$S_{transfer}=L_{spacing}+v_{constantspeed}\times t_{accelerating}/2-v_{constantspeed}\times t_{decelerating}/2=46\text{ mm}.$$

A first detection condition is ($t_{accelerating}$=50 ms)< ($S_{transfer}/V_{constantspeed}$=57.5 ms).

A second detection condition is:

$$(L_{outside}=90\text{ mm})>(S_{transfer}+v_{constantspeed}\times t_{decelerating}=54\text{ mm}).$$

The two conditions are met, hence the distance between the first sensor 102 and the second sensor 103 may be designed as $S_{transfer}$=46 mm, the space between adjacent banknotes in the temporary banknote storage device 100 may be controlled to be $L_{spacing}$=30 mm, and the space between adjacent banknotes in the device is 60 mm less than the space between adjacent banknotes in the channel outside the device, thereby greatly reducing the use of the tape and a structural space in the temporary banknote storage device and improving the storage capacity of the device.

Figure 6:
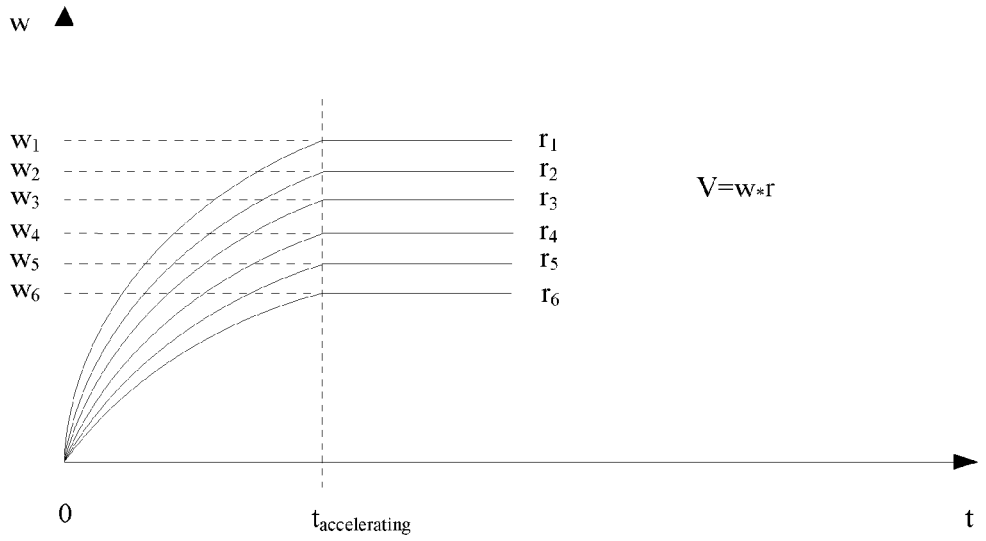
FIG. 6 is a w-t diagram showing start control for a first power motor.

A design principle of the period $t_{accelerating}$ for start and the period $t_{decelerating}$ for decelerating stop of the first power motor 109 is described in conjunction with FIG. 1 and FIG. 6.

During a process that banknotes 108 enter the temporary banknote storage device 100 and are stored on the storage reel 104 one by one, an outer diameter of the storage reel 104 increases continuously. In a condition that the constant operation speed of the transfer channel is $V_{constantspeed}$, a target rotation speed of the first power motor 109 needs to be decreased as a radius increases.

In the solution, different motor starting curves are adopted depending on different radiuses of the storage reel 104, to control the period $t_{accelerating}$ for accelerating start of the first power motor 109 to be a constant value. As shown in FIG.

6, 6 acceleration curves are adopted during the control (more acceleration curves may be adopted as needed). During a process that a rotation speed of the storage reel 104 is changed from w1 to w6, the outer diameter of the storage reel 104 increases accordingly, and periods for accelerating to the constant speed $V_{constantspeed}$ are $t_{accelerating}$ for all the 6 curves. During the control, the microprocessor 106 selects different acceleration curves for the first power motor 109 based on the number of banknotes 108 entering the temporary banknote storage device 100. During the actual control, the microprocessor 106 changes the acceleration curve every 50 banknotes (the number may be set based on the actual case) based on a count in the second sensor 13. 50 banknotes enter the temporary banknote storage device 100, the outer diameter of the storage reel 109 changes little, and hence the period for accelerating start for the first power motor 109 during a process that the 50 banknotes enter the temporary banknote storage device 100 may be approximately $t_{decelerating}$.

Since the first power motor 109 is in a deceleration way stopped quickly, the period $t_{decelerating}$ for decelerating stop changes little during decelerating stop processes for different target rotation speeds and may be approximately a constant value.

The period $t_{accelerating}$ for start and the period $t_{decelerating}$ for decelerating stop for the first power motor 109 can be determined based on the control method described above.

Only the preferable embodiments of the present disclosure are described above. It should be noted that the preferable embodiments are not intended to limit the present disclosure, and the scope of protection of the present disclosure should be based on the claims. Improvements and modifications may be made by those skilled in the art without departing from the spirit and scope of the present disclosure, and the improvements and modifications are regarded as falling within the scope of protection of the present disclosure.

The invention claimed is:

1. A temporary banknote storage device, comprising:

a storage reel, driven by a first power motor;

a spare tape reel, driven by a second power motor;

a tape, having two ends which are fixed on the storage reel and on the spare tape reel respectively, and being coiled, uncoiled and winded between the storage reel and the spare tape reel;

a first sensor, arranged at an entrance of the temporary banknote storage device and configured to detect whether a banknote enters the temporary banknote storage device;

a second sensor, arranged between the first sensor and the storage reel, being a certain distance $S_{transfer}$ from the first sensor, and configured to detect whether the banknote completely enters the temporary banknote storage device;

a transfer channel outside the device, arranged between the first sensor and the second sensor;

a third motor, configured to drive the transfer channel outside the device, to transfer the banknote from a position of the first sensor to a position of the second sensor at a constant speed; and a microcontroller, configured to control components to operate normally, control the first power motor to start acceleratingly when the first sensor detects a front end of the banknote, and control the first power motor to stop in a deceleration way when the second sensor detects leaving of a tail end of the banknote, wherein the microcontroller controls the first power motor to complete an accelerating start before the front end of the banknote arrives at the second sensor, and controls the first power motor to transfer, after the first power motor completes the accelerating start, the banknote from the position of the second sensor until the tail end of the banknote leaves the second sensor at a same speed as that of the third power motor, wherein $L_{outside}>S_{transfer}+2\times S_{decelerating}$, wherein the $L_{outside}$ refers to a space between two adjacent banknotes in the transfer channel outside the device, and the $S_{decelerating}$ refers to a distance for a first of the two adjacent banknotes transferred during decelerating stop of the first power motor after the tail end of the first of the two adjacent banknotes leaves the second sensor.

2. A method for improving a reel storage capacity of a temporary banknote storage device, comprising:

step 1, driving, by a third power motor, a channel outside the device, to transfer successive banknotes from a position of a first sensor to a position of a second sensor sequentially at a constant speed v, wherein a space between two adjacent banknotes in the channel outside the device is $L_{outside}$;

step 2, when the first sensor detects arrival of a front end of a banknote, starting acceleratingly a first power motor to drive a storage reel until a linear speed of a tape is equal to the speed v of the channel outside the device, wherein the first power motor already completes an accelerating start when the front end of the banknote enters the second sensor;

step 3, stopping in a deceleration way the first power motor when the second sensor detects arrival of a tail end of the banknote; and step 4, transferring, through performing the step 2 and the step 3 repeatedly, the banknotes to the temporary banknote storage device during a process that the banknotes successively enter the temporary banknote storage device, wherein in order to control the starting and stopping of the first power motor, i.e., for two adjacent banknotes, a tail end of a first banknote already leaves the second sensor and is in a deceleration way stopped when a front end of a second banknote arrives at the first sensor, it is required $L_{outside}>S_{transfer}+2\times S_{decelerating}$, wherein $S_{transfer}$ refers to a distance between the first sensor and the second sensor, and the $S_{decelerating}$ refers to a distance for the first banknote transferred during decelerating stop of the first power motor after the tail end of the first banknote leaves the second sensor.

3. The method for improving the reel storage capacity of the temporary banknote storage device according to claim 2, wherein from the step 2 to the step 4, the second power motor is in a braking state during a rotation of the first power motor, and the tape is tightened through a load of the temporary banknote storage device and a braking moment of the second power motor.

4. The method for improving the reel storage capacity of the temporary banknote storage device according to claim 2, wherein in the step 4, a space between two adjacent banknotes is $L_{spacing}$ after the banknotes enter the temporary banknote storage device, and a method for calculating the $L_{spacing}$ comprises:

a first step, calculating a transfer distance $S_{decelerating}$ of the first banknote from the time instant when the first banknote leaves the second sensor to the time instant when the first banknote is in a deceleration way stopped, $S_{decelerating}\approx v\times t_{decelerating}/2$, wherein a period of acceleration start for the first power motor is $t_{accelerating}$, a period of deceleration stop is $t_{decelerating}$, and the first banknote is already stored in the device;

a second step, calculating a constant rotation speed period $t_{constantspeed}$ of the first power motor before the front end of the second banknote arrives at the second sensor, $t_{constantspeed}=S_{transfer}/v-t_{accelerating}$, wherein the second banknote enters the device immediately following the first banknote, the first power motor is acceleratingly started when the front end of the second banknote arrives at the first sensor, the first banknote is driven by the tape to transfer continuously in the temporary banknote storage device, the second banknote is transferred on the transfer channel outside the device which is driven by the third power motor before the front end of the second banknote arrives at the second sensor, a transfer speed of the second banknote is v, a period from a time instant when the front end of the second banknote arrives at the first sensor to a time instant when the front end of the second banknote arrives at the second sensor is $S_{transfer}/v$, the first power motor already completes acceleration start and reaches a constant speed v before the front end of the second banknote arrives at the second sensor, and $t_{accelerating}<S_{transfer}/v$;

a third step, calculating a transfer distance $S_{acceterating}$ of the first banknote in the device during the accelerating start of the first power motor, $S_{accelerating}\approx v\times t_{accelerating}/2$, wherein the front end of the second banknote is transferred from the first sensor to the second sensor;

a fourth step, calculating a transfer distance $S_{constantspeed}$ of the first banknote during a period when the first power motor rotates at a constant speed before the front end of the second banknote arrives at the second sensor, $S_{constantspeed}=v\times t_{constantspeed}$; and a fifth step, calculating a space between the first banknote and the second banknote in the temporary banknote storage device, $$\begin{aligned} L_{spacing} &= S_{decelerating} + S_{accelerating} + S_{constantspeed} \\ &= v\times t_{decelerating}/2 + v\times t_{accelerating}/2 + v\times t_{constantspeed} \\ &= S_{transfer} - v\times t_{accelerating}/2 + v\times t_{decelerating}/2 \\ &= S_{transfer} - S_{accelerating} + S_{decelerating}, \end{aligned}$$

wherein $t_{accelerating}<S_{transfer}/v$, the second banknote gradually enters the temporary banknote storage device after the front end of the second banknote arrives at the second sensor, and reaches a same transfer speed as the first banknote, and the space between the first banknote and the second banknote remains constant.

5. The method for improving the reel storage capacity of the temporary banknote storage device according to claim 4, wherein during a process that the banknotes successively enter the temporary banknote storage device and are bound on the storage tape by the tape, an outer diameter of the storage reel increases continuously, in a condition of a constant operation speed v of the tape, a target rotation speed of the first power motor decreases as a radius increases, and different motor starting curves are adopted depending on different outer diameters of the storage reel, so that a starting period $t_{accelerating}$ of the first power motor for arriving at the target rotation speed is approximately a constant value for each banknote during changes of the outer diameter of the storage reel.

* * * * *